US012357114B2

(12) United States Patent
Smedley

(10) Patent No.: US 12,357,114 B2
(45) Date of Patent: Jul. 15, 2025

(54) RETAIL MERCHANDISE SHELVING SYSTEM AND DECK PANELS FOR SAME

(71) Applicant: Jamie A. Smedley, Hudson, OH (US)

(72) Inventor: Jamie A. Smedley, Hudson, OH (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

(21) Appl. No.: 18/972,631

(22) Filed: Dec. 6, 2024

(65) Prior Publication Data

US 2025/0089914 A1 Mar. 20, 2025

Related U.S. Application Data

(63) Continuation of application No. 18/760,900, filed on Jul. 1, 2024, which is a continuation of application No. 17/308,775, filed on May 5, 2021, now Pat. No. 12,053,106.

(60) Provisional application No. 63/031,344, filed on May 28, 2020.

(51) Int. Cl.
*A47F 5/00* (2006.01)
*A47B 96/02* (2006.01)

(52) U.S. Cl.
CPC ..... *A47F 5/0043* (2013.01); *A47B 96/021* (2013.01); *A47B 96/028* (2013.01); *A47F 5/0018* (2013.01)

(58) Field of Classification Search
CPC .... A47F 5/0043; A47F 5/0018; A47B 96/021; A47B 96/028
See application file for complete search history.

(56) References Cited

U.S. PATENT DOCUMENTS 2,305,244 A * 12/1942 Erickson ..... A47F 5/0018 108/6
2,933,195 A * 4/1960 Radek ..... A47B 57/58 248/220.42
3,237,779 A 3/1966 Eger
3,285,428 A 11/1966 Scheck
3,297,374 A 1/1967 Radek
3,298,503 A 1/1967 Field et al.
3,302,800 A 2/1967 Zdanowski
3,358,847 A * 12/1967 Magnuson ..... A47G 25/0664 211/186
3,403,787 A 10/1968 Browning
3,465,891 A 9/1969 Rose
(Continued)

FOREIGN PATENT DOCUMENTS

CN 104433528 A 3/2015
CN 207921581 U 9/2018
(Continued)

*Primary Examiner* — Stanton L Krycinski
(74) *Attorney, Agent, or Firm* — Reinhart Boerner Van Deuren P.C.

(57) ABSTRACT

A deck panel for a retail shelving system is provided. The deck panel includes a panel and a region of strengthening ribbing. The panel has a top surface configured for supporting retail merchandise and a bottom surface. The region of strengthening ribbing includes a plurality of ribs extending outward from the bottom surface of the panel. The bottom surface of the panel has a border region that extends around the region of strengthening ribbing on at least three sides. The deck panel may be part of a shelf which may be part of a shelving system.

16 Claims, 10 Drawing Sheets

(56) References Cited

U.S. PATENT DOCUMENTS 3,610,427 A 10/1971 Maziarka et al.
3,827,574 A 8/1974 Craig, Sr.
4,078,664 A 3/1978 McConnell
4,250,679 A 2/1981 Burg
4,467,927 A * 8/1984 Nathan ..... A47B 87/0223 211/186
4,540,222 A * 9/1985 Burrell ..... A47F 3/00 211/186
4,665,838 A 5/1987 Minshall
4,760,930 A * 8/1988 Fox ..... A47B 96/07 248/250
4,815,394 A * 3/1989 Ettlinger ..... A47B 57/265 108/107
4,955,490 A 9/1990 Schäfer
5,279,431 A 1/1994 Highsmith et al.
5,310,066 A 5/1994 Konstant
5,433,152 A * 7/1995 Henry ..... A47K 10/04 108/42
5,628,415 A 5/1997 Mulholland
5,709,158 A * 1/1998 Wareheim ..... A47B 87/0246 211/188
6,006,926 A * 12/1999 O'Reilly ..... A47F 5/12 211/186
6,105,798 A 8/2000 Gruber et al.
6,257,425 B1 7/2001 Liu
6,257,427 B1 7/2001 Schneid
7,784,413 B2 8/2010 Gabriel et al.
7,810,487 B2 10/2010 Johnston
8,141,723 B2 * 3/2012 Whalen ..... A47F 5/0043 211/135
9,027,767 B2 5/2015 Buckley et al.
9,375,102 B2 6/2016 Troyner et al.
10,123,617 B2 * 11/2018 Rollins ..... A47B 96/021
10,123,637 B1 * 11/2018 DeSena ..... A47F 5/0068
10,206,506 B1 2/2019 Lai et al.
10,334,970 B2 7/2019 Buck et al.
10,441,094 B2 * 10/2019 Kim ..... B65G 1/026
D875,448 S * 2/2020 Reinhart ..... D6/705.7
10,709,238 B1 * 7/2020 Thompson ..... A47B 96/066
11,246,396 B2 * 2/2022 Boos ..... A47B 96/021
11,268,284 B2 3/2022 Ohrstrom
11,304,546 B1 * 4/2022 Boos ..... A47B 57/04
11,350,743 B2 * 6/2022 Reinhart ..... A47B 87/0215
11,369,215 B2 * 6/2022 Obitts ..... A47B 57/04
11,389,015 B2 * 7/2022 Smedley ..... A47B 45/00
11,583,110 B2 * 2/2023 Smedley ..... A47F 5/103
11,612,245 B2 3/2023 Meiser
11,998,125 B2 * 6/2024 Smedley ..... A47B 57/40
2009/0107941 A1 * 4/2009 Liao ..... A47B 87/0246 211/153
2010/0116760 A1 * 5/2010 Fazzone ..... G09F 3/204 211/49.1
2010/0133219 A1 6/2010 Sun
2012/0285915 A1 * 11/2012 O'Quinn ..... A47B 96/021 29/401.1
2014/0263128 A1 * 9/2014 Garrett ..... A47F 5/0815 211/144
2019/0116977 A1 * 4/2019 Lindblom ..... A47B 96/021
2021/0059385 A1 * 3/2021 Boos ..... A47F 5/12

FOREIGN PATENT DOCUMENTS

FR 2988279 A1 * 9/2013 ..... A47B 45/00
KR 20070109517 A 11/2007

* cited by examiner

RETAIL MERCHANDISE SHELVING SYSTEM AND DECK PANELS FOR SAME

CROSS-REFERENCE TO RELATED PATENT APPLICATIONS

This Patent Application is a Continuation of U.S. patent application Ser. No. 18/760,900, filed Jul. 1, 2024, which is a Continuation of U.S. patent application Ser. No. 17/308,775, filed May 5, 2021, which issued as U.S. Pat. No. 12,053,106 on Aug. 6, 2024. This Patent Application claims the benefit of U.S. Provisional Patent Application No. 63/031,344, filed May 28, 2020, the entire teachings and disclosures of all applications are incorporated herein by reference thereto.

FIELD OF THE INVENTION

This invention generally relates to retail displays, and more particularly to retail shelving systems.

BACKGROUND OF THE INVENTION

Retail shelving is a staple in the retail merchandise environment. While such shelving comes in many forms, it generally includes a vertical support structure which supports one or more shelves extending outwardly from the vertical structure. The vertical structure is typically a wall-like structure and contains integrated mounting rails, referred to in in the industry as gondola uprights, to which the shelves.

The shelves of such shelving systems present several drawbacks. These shelves are typically steel structures which can corrode over time and which are heavy making them difficult to remove for cleaning. One alternative has been to utilize aluminum shelving instead, but this material results in a more costly system. Also, such steel or aluminum shelves do not meet the requirements for NSF Certification by NSF International, which is a highly desired certification in certain retail display applications in which the shelving surface comes into direct contact with the product being merchandised.

Examples of the present application provide improvements over the current state of the art as it relates to retail shelving systems.

BRIEF SUMMARY OF THE INVENTION

In one example, a deck panel for a retail shelving system is provided. The deck panel is used to support merchandise. The deck panel includes a panel and a region of strengthening ribbing. The panel has a top surface configured for supporting retail merchandise and a bottom surface. The region of strengthening ribbing includes a plurality of ribs extending outward from the bottom surface of the panel. The bottom surface of the panel has a border region that extends around the region of strengthening ribbing on at least three sides.

In a particular example, the border region is substantially flat (e.g. projections that are greater than 25% of the thickness of the panel are not present extending from the border region.

In an example, the panel has a front edge, a rear edge and a pair of side edges extending between the front edge and the rear edge. The border region extends along the pair of side edges and the rear edge.

In an example, the border region has a thickness measured perpendicular to the bottom surface. The plurality of ribs extending outward from the bottom surface have an average height that is measured perpendicular to the bottom surface. The average height is at least five times the thickness.

In an example, the border region is free of projections.

In an example, the border region includes apertures extending entirely through a thickness of the border region (e.g. through the top and bottom surfaces).

In an example, the front edge is provided by a vertical wall that extends outward beyond the top surface and outward beyond the bottom surface.

In an example, a plurality of the plurality of ribs are all interconnected with one another and interconnected with the vertical wall.

In an example, a first portion of the border region extends between the vertical wall and the rear edge along one of the pair of side edges. A second portion of the border region extends between the pair of side edges along the rear edge. A third portion of the border region extends between the vertical wall and the rear edge along the other one of the pair of side edges.

In an example, the border region is free of projections.

In an example, the panel has a generally rectangular periphery. The region of strengthening ribbing may optionally have a rectangular periphery as well.

In an example, the region of strengthening ribbing has an outer periphery that includes pair of opposed sides and a rear side. These sides may be provided by outer most ribs extending outward from the bottom surface (e.g. generally perpendicular-plus/minus 15 degrees). The opposed sides are generally parallel. The rear side is generally perpendicular to the sides of the pair of opposed sides. The pair of opposed sides is parallel to and spaced inward from the pair side edges and the rear side is parallel to and spaced inward from the rear edge.

In an example, the border region is free of projections or apertures in the portion thereof extending along the rear edge.

In an example, the panel includes a plurality of apertures extending through the top and bottom surfaces. The ribs do not extend across any of the apertures such that the ribs do not have a portion of an aperture on one side of the rib and apportion of the same aperture on the other side of the rib. The ribs may be immediately adjacent apertures.

In another example, a shelf is provided. The shelf includes first and second support arms, front and rear support bars and a deck panel as outlined above. The first and second support arms are arranged in opposed lateral spaced relation to one another. The front and rear support bars extend laterally between the first and second support arms. The deck panel is supported by the front and rear support bars. The border region extends over the first and second support arms. The region of strengthening ribbing is positioned laterally between the first and second support arms.

In another example, a shelf is provided. The shelf includes first and second support arms, front and rear support bars and a deck panel. The first and second support arms are arranged in opposed lateral spaced relation to one another. The front and rear support bars extend laterally between the first and second support arms. The deck panel is supported by the front and rear support bars. The deck panel includes a panel having a top surface configured for supporting retail merchandise and a bottom surface. The deck panel includes a region of strengthening ribbing including a plurality of ribs extending outward from the bottom surface of the panel. The bottom surface has a border region that extends around the region of strengthening ribbing on at least three sides. The border region extends over the first and second support arms. The region of strengthening ribbing being positioned laterally between the first and second support arms.

In an example, the portion of the border region that extends over the first support arm is unitarily formed as a single piece with the portion of the border region that extends over the second support arm.

In an example, the border region extends laterally outward beyond the first and second support arms.

In an example, the region of strengthening ribbing includes a front channel and a rear channel. The front support bar is received in the front channel and the rear support bar is received in the rear channel.

In an example, for each of the front and rear channels, a bottom thereof is defined by short rib regions. The top of the front and rear support bars abut the short rib regions.

In an example, each of the first and second support arms has a top surface. The border region is vertically spaced from the top surface of the first and second support arms. A gap may be formed therebetween.

In an example, the shelf includes a single deck panel extending laterally beyond both of the the first and second support arms and being supported by the front and rear support bars.

In an example, the deck panel includes resilient finger tabs that snap engage the deck panel to at least one of the front and rear support bars.

In another example, a shelving system including a deck panel or shelf as outlined above is provided. The shelving system includes a pair of upright supports. Each upright support has an upper end and a lower end. Each upright support has a plurality of apertures mounting the first and second support arms thereto.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
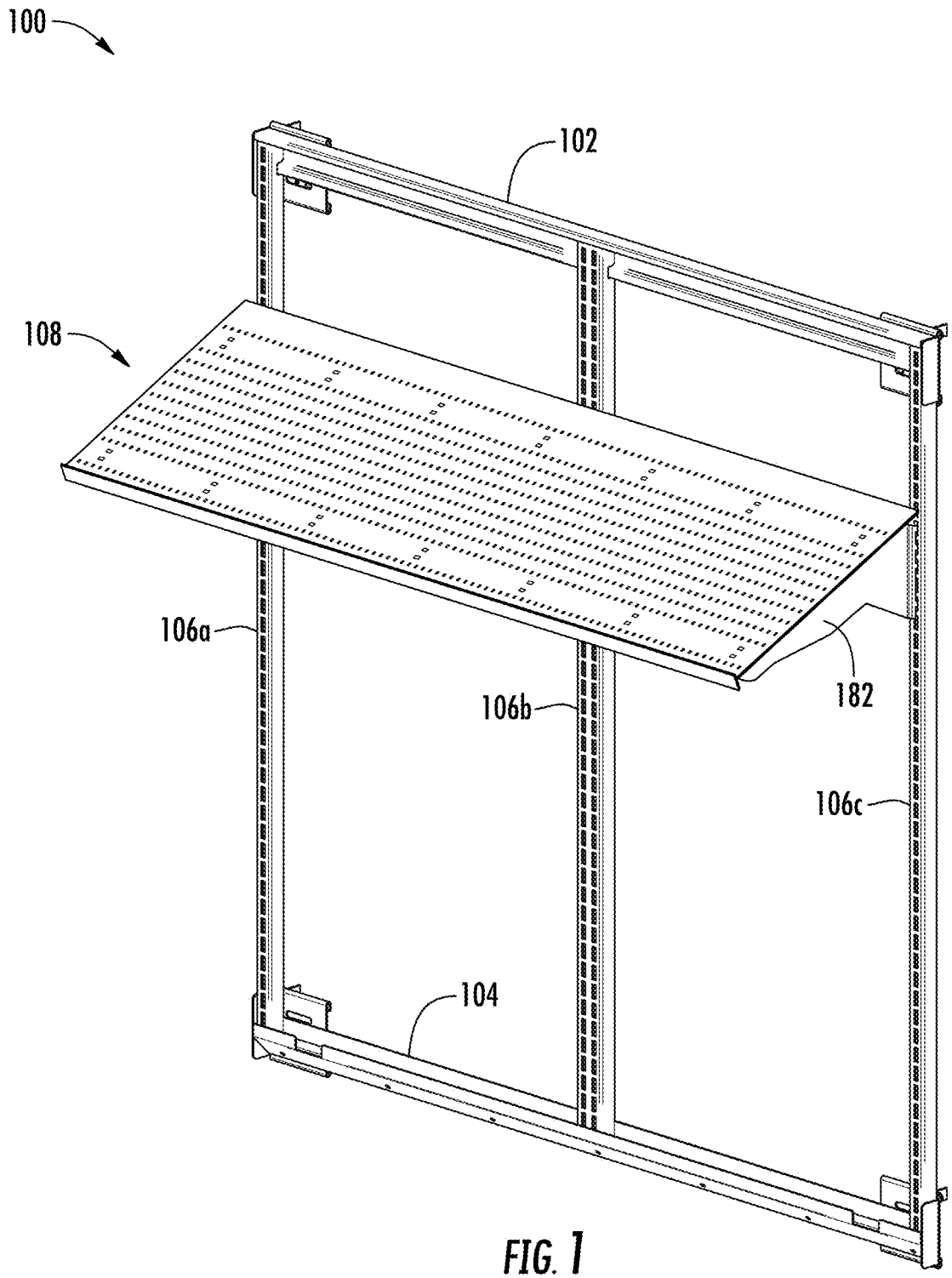
FIG. 1 is a perspective view of an exemplary embodiment of a retail shelving system according to the teachings herein.

With specific reference now to FIG. 1, the same illustrates an exemplary embodiment of a shelving system 100 according to the teachings herein. Shelving system 100 includes a grid assembly with one or more shelves 108 mounted thereto. While one shelf 108 is shown, it is contemplated that any number of shelves may be mounted to this grid assembly. Further, while shelf 108 illustrated the full length of the grid assembly, shorter shelf lengths are entirely possible.

The grid assembly itself may be that as previously disclosed in U.S. patent application Ser. No. 16/222,722, filed Dec. 17, 2018, entitled "Retail Shelving System," the teachings and disclosures of which are incorporated herein by reference thereto.

The grid assembly includes an upper rail 102 and a separate lower rail 104. Upper and lower rails 102, 104 are configured to mount to a support structure such as a vertical wall, the interior of a refrigerated or freezer case, etc. Indeed, upper and lower rails 102, 104 may be adapted to mount to any structure capable of supporting the same. As such, upper and lower rails 102, 104 may incorporate any mounting expedient, including screws, bolts, pins, hooks, ledges, etc.

In the illustrated embodiment, the upper and lower rails 102, 104 are separate components. As a result, they may be separately installed to the aforementioned support structure. This makes installation simpler than in prior designs which require lifting a large welded grid structure as a single unit and installing it in place on a support structure.

A plurality of upright supports 106*a*, 106*b*, 106*c* are slidably received in upper and lower rails 102, 104. Upright supports 106*a-c* are used for mounting shelf 108 thereto. It should be noted that three upright supports 106*a-c* are illustrated for purposes of description. However, only the outer most upright supports 106*a*, 106*c* are needed for mounting the illustrated shelf 108. Multiple additional shelves 108 may mount to the same two upright supports 106*a*, 106*c* below shelf 108 as illustrated. Further, shelves 108 having a shorter length may be mounted between upright supports 106*a* and 106*b*, or between upright supports 106*b* and 106*c*. Unless otherwise specifically noted herein, any description of the structure, function, or use of one upright support 106*a-c* applies equally to the others. Additionally, when multipole shelves are mounted to the upright supports 106*a-c*, the shelves may be identical or different such as, for example only, different lengths, different angles, different depths, etc.

Having separate upright supports 106*a-c* provides the ability to add or remove a desired number of upright supports as discussed below to allow for a specific shelving configuration. Welded designs, such as ones having a fixed number of upright supports are also permissible in some implementations. The number of upright supports will be entirely dependent upon the shelving configuration desired. Therefore, the three upright supports 106*a-c* should be taken as only one of many possible examples. While two rails 102, 104 are shown and described, it is contemplated that only a single upper rail 102 could be utilized for receiving and supporting upright supports 106*a-c*.

While the modular system is illustrated, embodiments according to the present invention can use, cooperate with or be mounted to welded designs where the grid is a single welded assembly. Further in some embodiments, the upper and lower rails may not be required at all and only upright supports 106*a-c* may be used.

Figure 2:
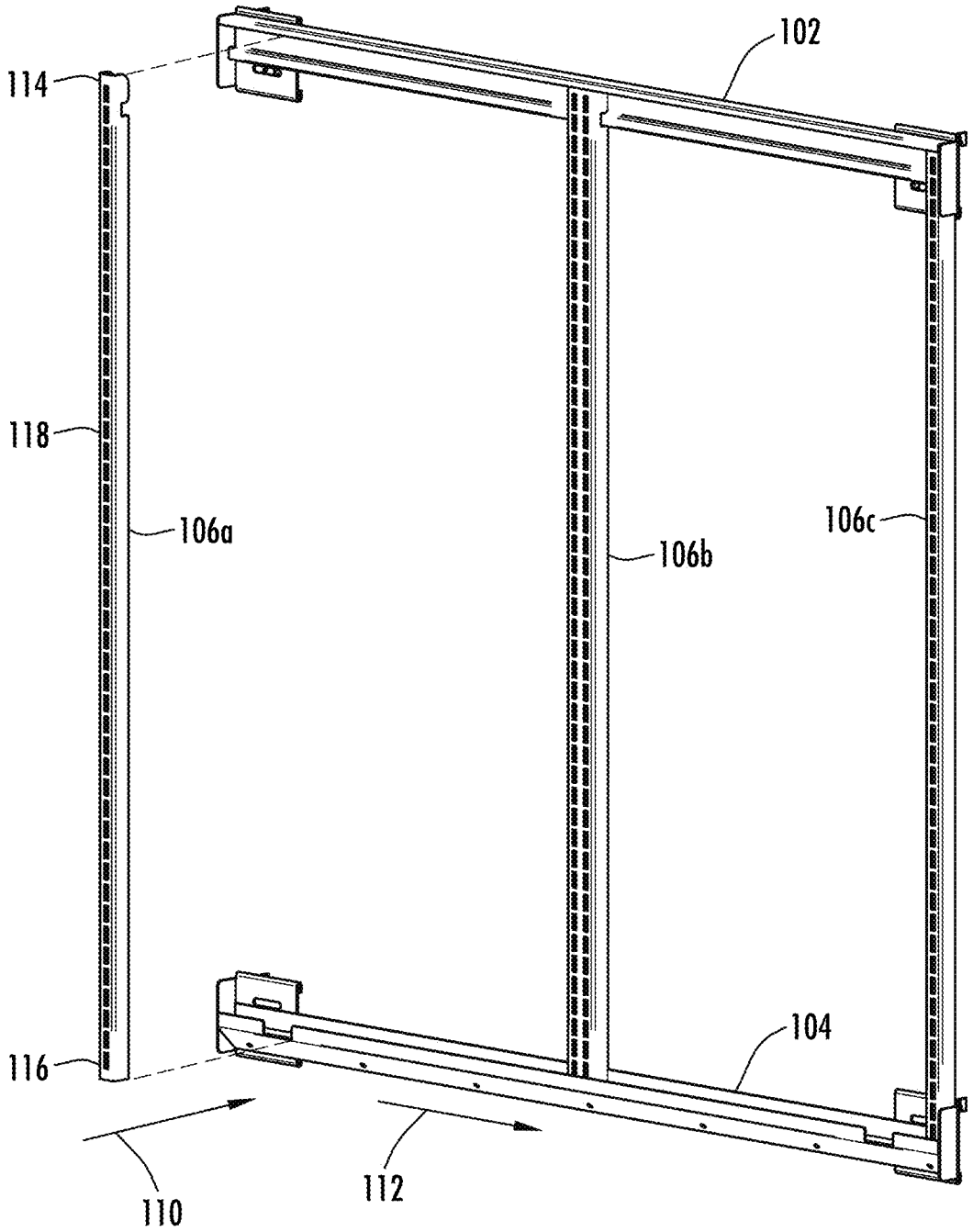
FIG. 2 is a perspective exploded view of a grid assembly of the retail shelving system of FIG. 1.

Turning now to FIG. 2, once upper and lower rails 102, 104 are installed, each upright support 106*a-c* is installed by generally situating the upright supports 106*a-c* into upper and lower rails 102, 104 by moving them generally in direction 110, and then sliding them in direction 112 to their final destinations. Upper and lower rails 102, 104 are designed such that they each include a channel within which the end portions of the upright supports 106*a-c* are situated and slidable in.

Indeed, referring specifically to upright support 106*a* shown in FIG. 2, the same includes an upper end 114 and a lower end 116. A plurality of apertures 118 are formed therein for shelf mounting. These apertures 118 may take on any shape. An identical description to that of upright support 106*a* applies to 106*c*. Upright support 106*c* differs only in that it include two parallel rows of apertures 118 as illustrated. In many situations, and as illustrated, apertures 118 may be vertically elongated.

Figure 3:
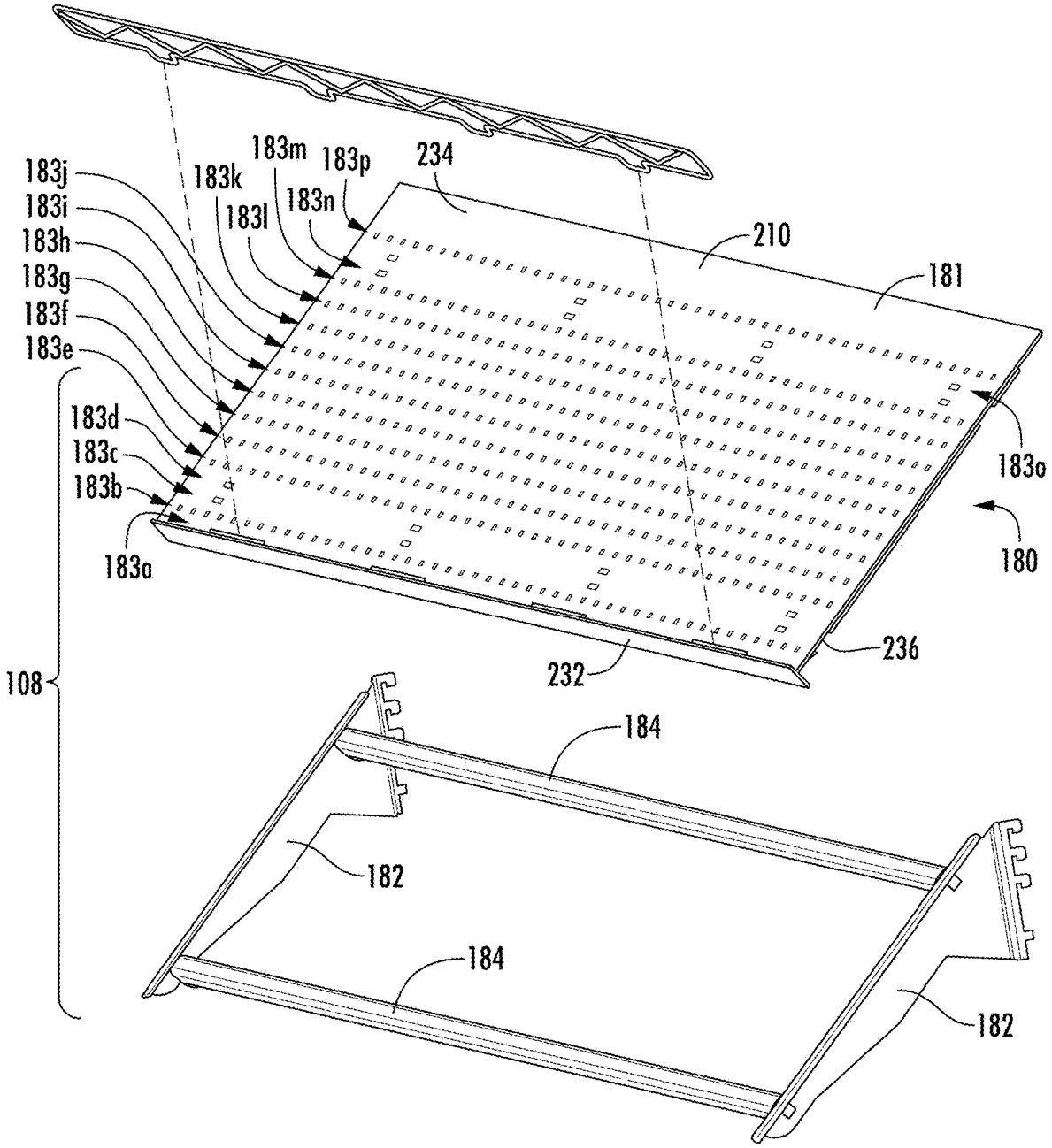
FIG. 3 is a perspective exploded view of a shelf of the retail shelving system of FIG. 1.
Figure 4:
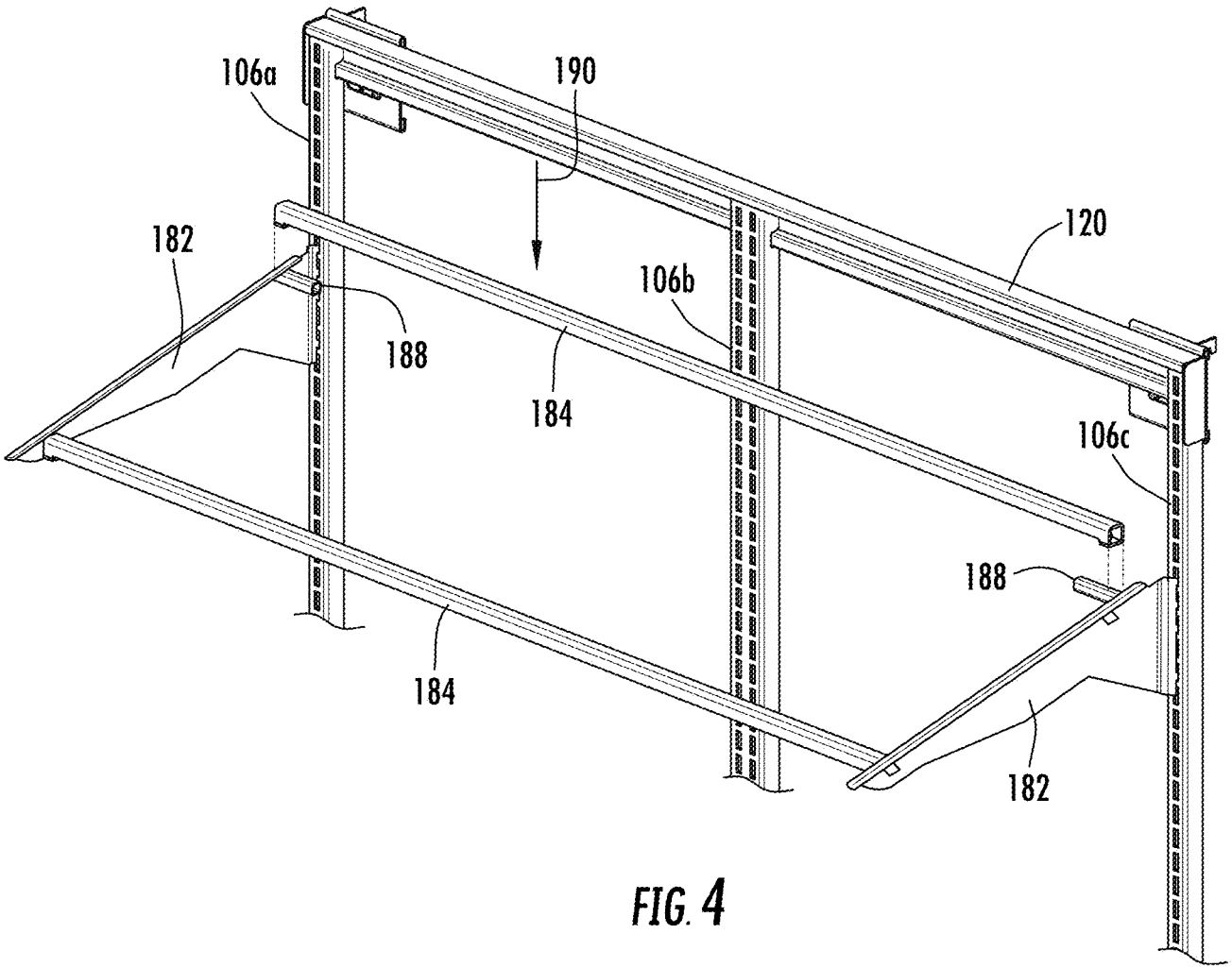
FIG. 4 is another perspective partially exploded view of the retail shelving system of FIG. 1.

Turning now to FIGS. 3-4, the same illustrate shelf 108 in greater detail. With particular reference to FIG. 3, shelf 108 includes a deck panel 180. In one embodiment, the shelves 108 have a width that is four feet measured from side edge 234 to side edge 236. However, other widths are contemplated. Although illustrated as mounting the grid assembly discussed above relative to FIGS. 1-2, it is contemplated that shelf 108 may be configured to mount to any existing structure by minor modification of the structure it utilizes for mounting. More generally, it is contemplated by the teachings herein, that the invention may be embodied as a combined system as reflected in FIG. 1 for example, or as a standalone shelf 108 that may be retrofit into an existing system.

Deck panel 180 generally includes a panel 181 that is generally planar. The panel 181 includes an upper surface 210 which is used to support merchandise. Deck panel 180 may include perforations that extend through panel 181 as shown, or any other features typical of retail shelving, e.g. features for mounting a front fence (not shown), features for mounting dividers (not shown), a price channel or price channel support 232, channels or other features for receiving and retaining lighting elements, etc. Deck panel 180 may be formed of a plastic material, for example, an acrylonitrile butadiene styrene (ABS) plastic. Such a material selection allows for the use of NSF certified materials for contacting retail items such as produce or the like.

Further, because deck panel 180 is separable and removable from the remainder of shelf 108, it may be easily cleaned in a dishwasher, sink, etc. Yet further, although not illustrated, pusher systems and other front facing devices may be readily mounted to deck panel 180.

Still referring to FIG. 3, in addition to deck panel 180, shelf 108 includes a frame that supports the deck panel. The frame generally includes first and second support arms 182 that are laterally spaced apart arranged at opposed sides of shelf 108. Support arms 182 are mirror images of one another, so a description of one applies equally well to the other. The frame of shelf 108 also generally includes front and rear support bars 184 which are also identical to one another. The front and rear support bars 184 are secured between and extend laterally between support arms 182.

Turning now to FIG. 4, shelf 108 is rapidly installable to the above described grid assembly by the following general process. First, each support arm 182 is mounted to a respective upright support 106*a-c*. In the illustrated embodiment, the left-most support arm 182 is mounted to upright support 106*a*, and the right-most support arm 182 is mounted to upright support 106*c*. Thereafter, each support bar is 184 is installed by moving the same generally in direction 190 until a support post 188 of each support arm 182 is situated within a channel of each support bar 184. Once support bars 184 are in place, deck panel 180 is then affixed to support bars 184.

Alternatively, where support bars 184 are closed profile tubular elements, it is also contemplated that each support bar 184 is installed by horizontally sliding it onto the mounting post 188 of each support arm 182. Such an operation may be done prior to installing support arms 182 onto their associated upright support. Further, although a front and rear support bar 184 are shown, it is contemplated that for deeper shelves, additional support bars 184 intermediate of front and rear support bars 184 could be utilized as well. Likewise, it is also contemplated that shallower shelf depths may only require a single support bar 184. As such, it is contemplated that at least one support bar 184 may be utilized for supporting the deck panel 180 of shelf 108.

Still further, although shelf 108 is described as mounting to two separate upright supports 106*a*, 106*c*, it is contemplated that shelf 108 may mount to a single upright support. Such a single upright support may be wider than those shown to accommodate mounting multiple support arms 182. For example, shelf 108 may mount to upright support 106*b* alone. Upright support 106*b* includes a double row 118 and can thus accommodate two support arms. The overall width of such a single upright support 106*b* may be varied to accommodate varying width shelves. As such, it is contemplated that at least one upright support is all that is required at a minimum for shelf mounting.

Figure 5:
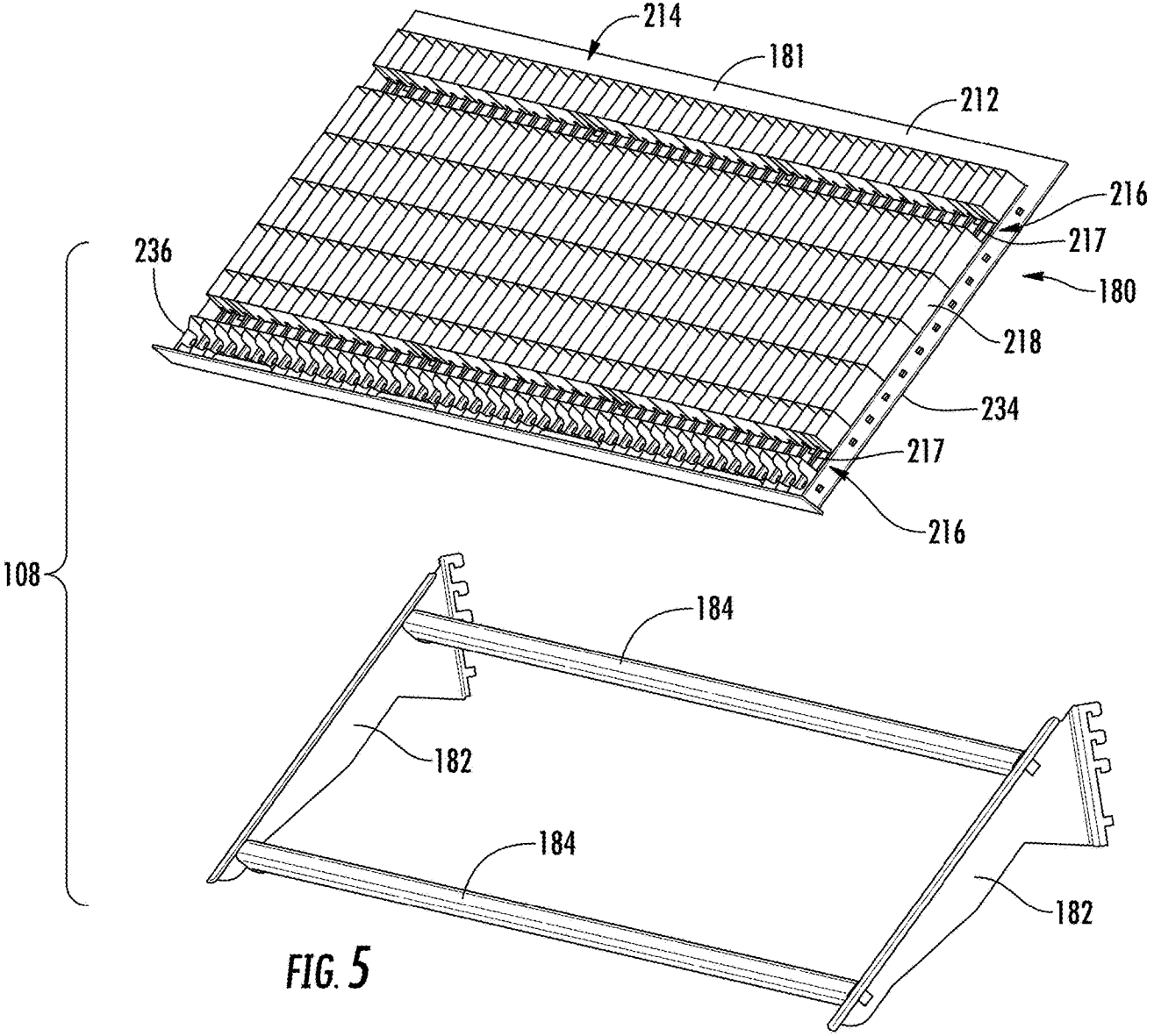
FIG. 5 is a perspective exploded view of a shelf of the retail shelving system of FIG. 1.
Figure 6:
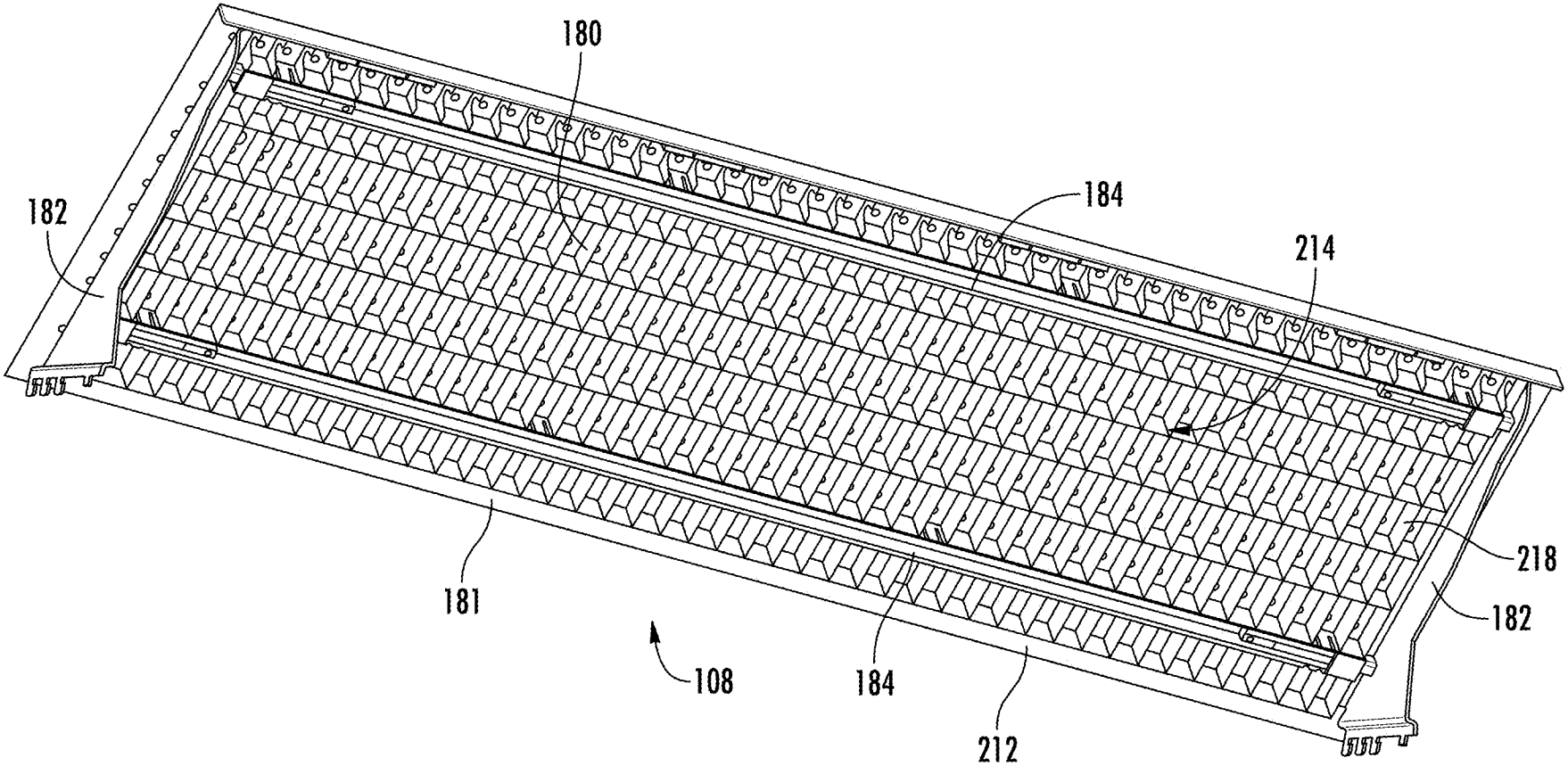
FIG. 6 is a bottom perspective view of the shelf of FIG. 5.

FIG. 5 is similar to FIG. 3, but with the deck panel 180 flipped over to illustrate the bottom side of the deck panel 181 and the bottom surface 212 of the panel 181. FIG. 6 shows the shelf 108 from a bottom side with the deck panel 180 attached to support arms 182 and support bars 184.

Figure 12:
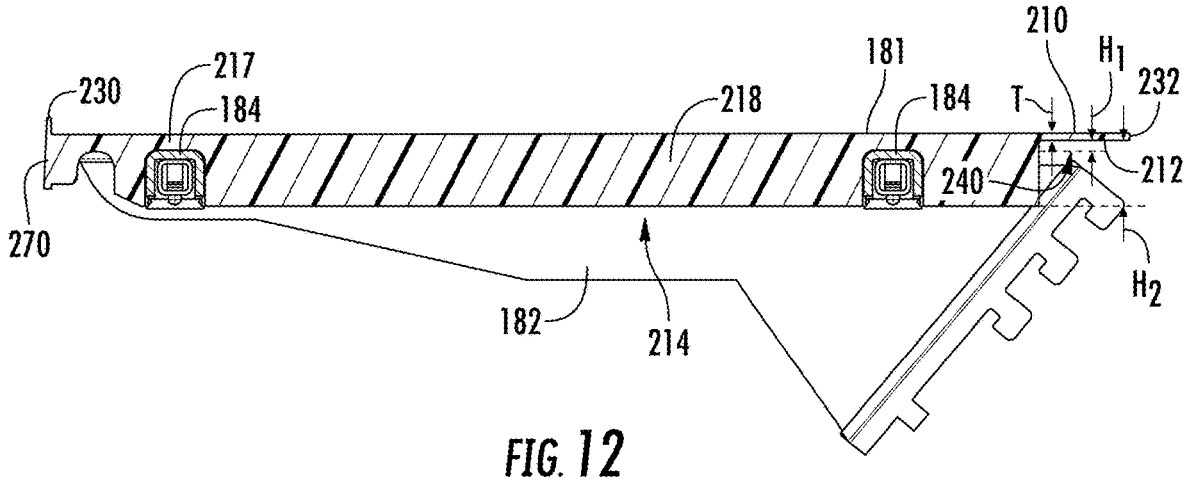
FIG. 12 is a cross-sectional illustration of the shelf of FIG. 5.
Figure 13:
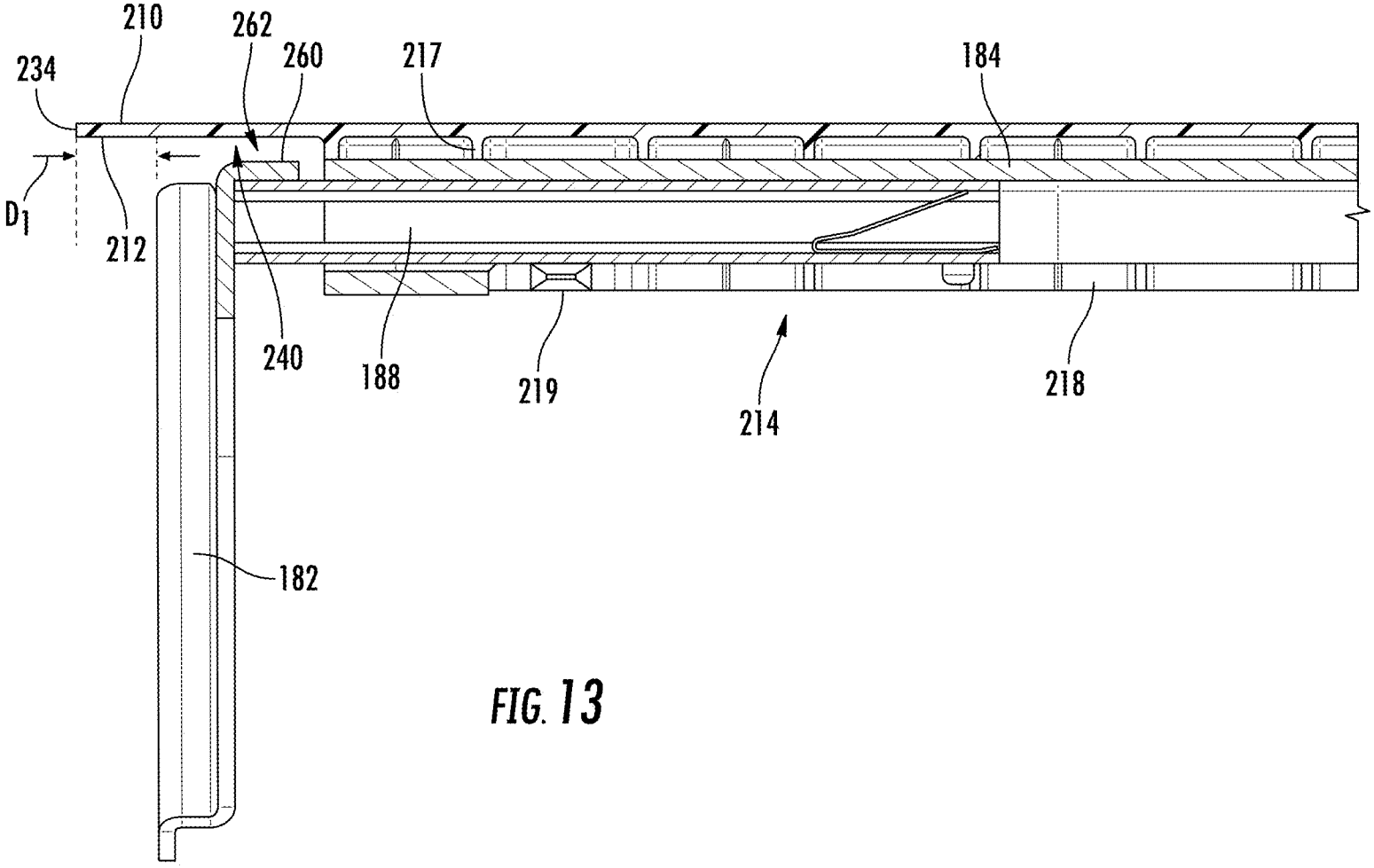
FIG. 13 is a cross-sectional illustration of the deck panel mounted to the frame structure of the shelf of the system of FIG. 1.

Deck panel 180 includes a region of strengthening ribbing 214 extending outward from bottom surface 212. A front and a rear channel 216 extends through/are formed by the region of strengthening ribbing 214. The channels 216 formed by the region of strengthening ribbing 214 receive support bars 184 therein (see e.g. FIGS. 6, 7 and 12). The bottom of the channels 216 are formed by shorter ribs 217 of the plurality of ribs forming the region of strengthening ribbing 214 (see also FIG. 13).

Figure 8:
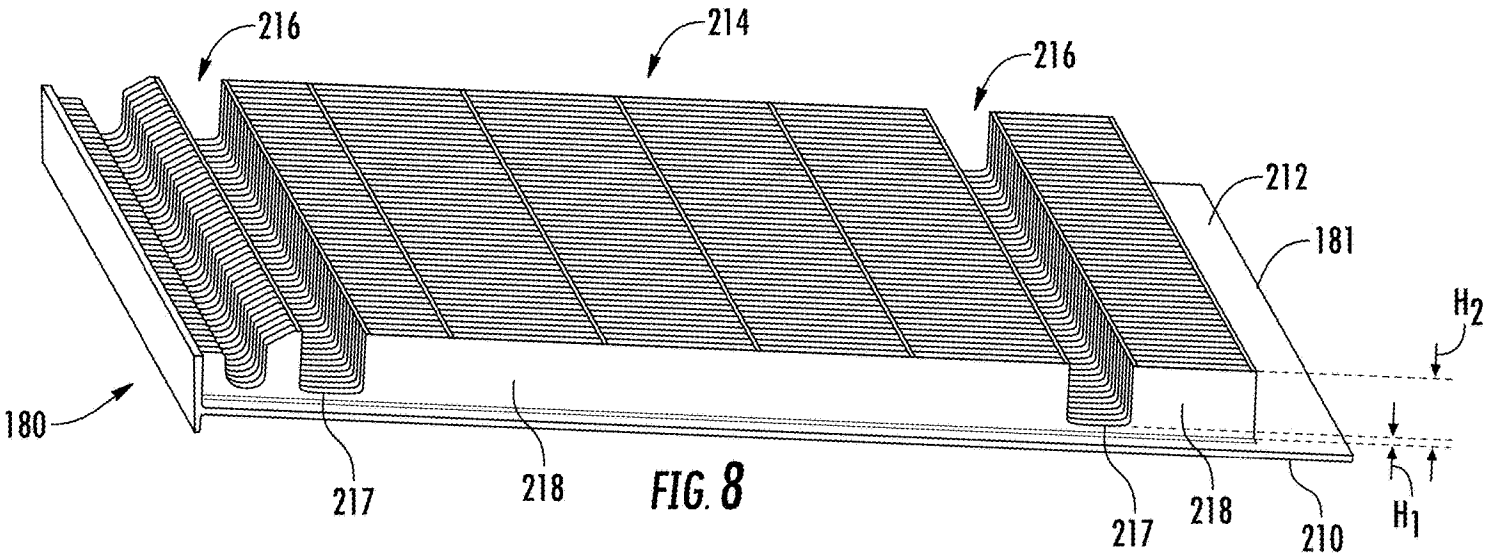
FIG. 8 is a perspective view of the deck panel of the shelf of FIG. 5.
Figure 9:
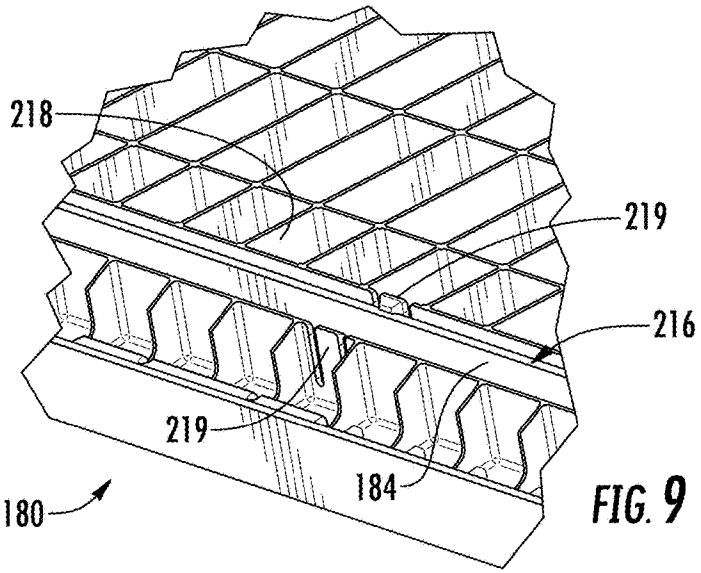
FIG. 9 is an enlarged perspective view of the deck panel of FIG. 8.

These channels 216 and shorter ribs 217 are further illustrated in FIG. 8. The short ribs 217 have a height extending from bottom surface 212 of panel 181 that is less than the height of the surrounding ribbing, which forms a majority of the ribs forming the region of strengthening ribbing 214. The height H1 of the short ribs 217 (e.g. distance extending perpendicularly from bottom surface 212) may be less than half of the height H2 of the other ribs 218 (e.g. distance extending perpendicularly from bottom surface 212), and preferably less than twenty five percent of the height of the other ribs 218.

In an example, the height H1 is about equal to the thickness T of the panel 181. In a preferred embodiment, the height H2 is at least five (5) times the thickness T of the panel 181.

Each channel 216 includes finger tabs 219 which may snap engaged with the associated support bar 184 to secure deck panel 180 to support bars 184. Although a front and rear channel 214, 216 are shown, the number of channels utilized may be varied to accommodate fewer or greater support bars 184.

Figure 10:
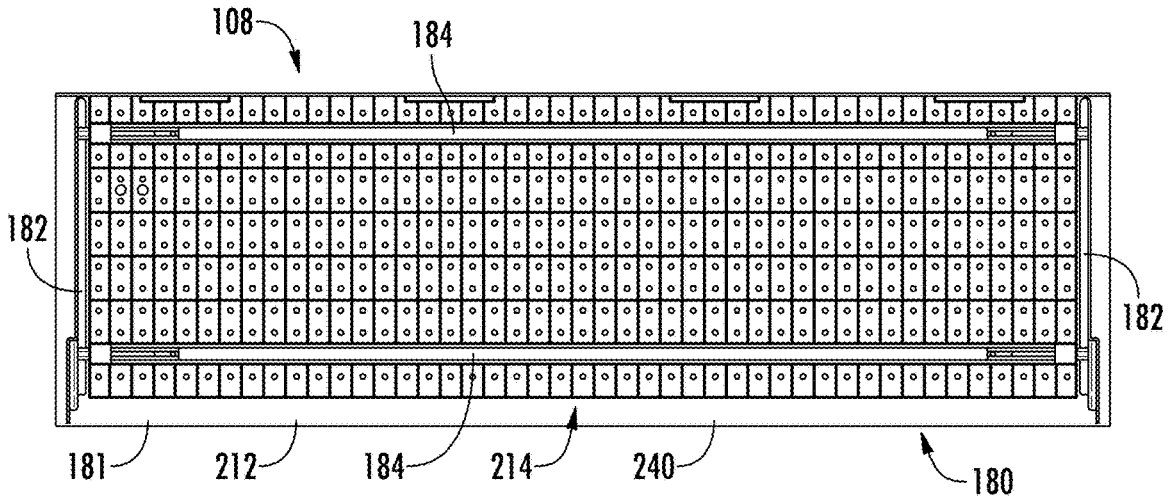
FIG. 10 is a bottom view of the shelf of the system of FIG. 1.
Figure 11:
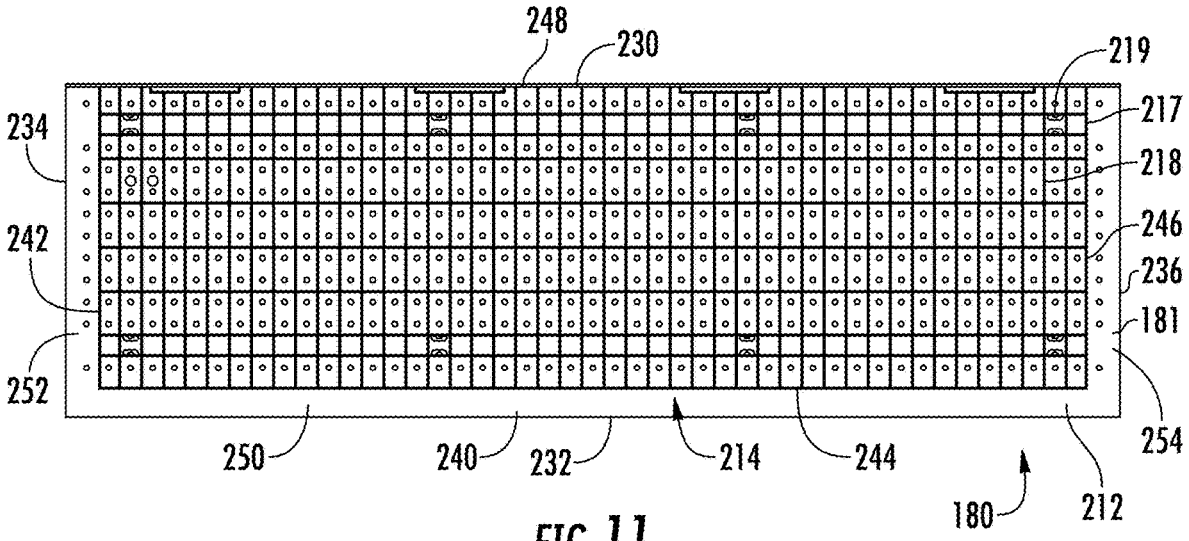
FIG. 11 is a bottom view of the deck panel of the shelf of FIG. 10.

FIG. 10 is a bottom view of the shelf 108 and FIG. 11 is a bottom view of the deck panel 180 removed from the support frame components (e.g. support arms 182 and support bars 184).

The bottom surface 212 of the panel 181 forms a border region 240 that extends around at least three sides of the region of strengthening ribbing 214.

In an embodiment, the border region 240 is substantially flat, e.g. does not include any projections or includes projections/surface ornamentation that does not have a height extending from bottom surface 212 that is more than twenty (20) percent and even more preferably no more than fifteen (15) percent the thickness of the panel 181 between the top surface 210 and bottom surface 212. In one example, the thickness of the panel is approximately two (2) millimeters while any surface ornamentation is 0.25 millimeters. This shall still be considered flat.

In this example, the panel 181 is generally rectangular and has front and rear edges 230, 232 and opposed laterally spaced apart side edges 234, 236. The region of strengthening ribbing 214 has a generally rectangular periphery and has opposed sides 242, 246 that are laterally spaced apart and front side 248 and rear side 244. The front side 248 generally corresponds to front edge 230. The rear side 244 is generally parallel to and spaced inward from rear edge 232. Opposed sides 242, 246 are generally parallel to and spaced inward from side edges 234, 236.

In the illustrated example, a rear portion 250 of the border region 240 extend along and between the rear edge 232 of panel 181 and rear side 244 of the region of strengthening ribbing 214 is free of any projections at all and is free of any apertures therethrough.

However, side portions 252, 254 of the border region 240 that extend along and between the side edges 234, 236 of panel 181 and sides 242, 246 of the region of strengthening ribbing 214 includes apertures spaced outward from the sides 242, 246.

In an example, the side portions 252, 254 extend laterally outward beyond the corresponding support arms 182. This illustrated in FIG. 13, where the side edge 234 is spaced a distance D1 from the laterally outer most portion of support arm 182.

Further, in an example, the bottom surface 212 and particularly the border region 240 thereof is vertically spaced from the top surface 260 of the support arms 182, forming a gap 262 therebetween.

In the illustrated example, the front edge 230 is provided by a vertical wall 270. This vertical wall may be used to attach labels or label holders. The vertical wall 270 extends upward beyond the top surface 210 and downward beyond the bottom surface 212. The ribs 218 of the region of strengthening ribbing 214 connect with the bottom portion of vertical wall 270.

The upper portion of vertical wall 270, e.g. the portion that extends upward of the top surface 210 may be used as a front stop to prevent merchandise from sliding off of the deck panel 180.

In a preferred example, the apertures that extend through panel 181 do not align with any of the ribs 217, 218 such that a rib extends across an aperture. This reduces debris from being trapped within the apertures.

Figure 7:
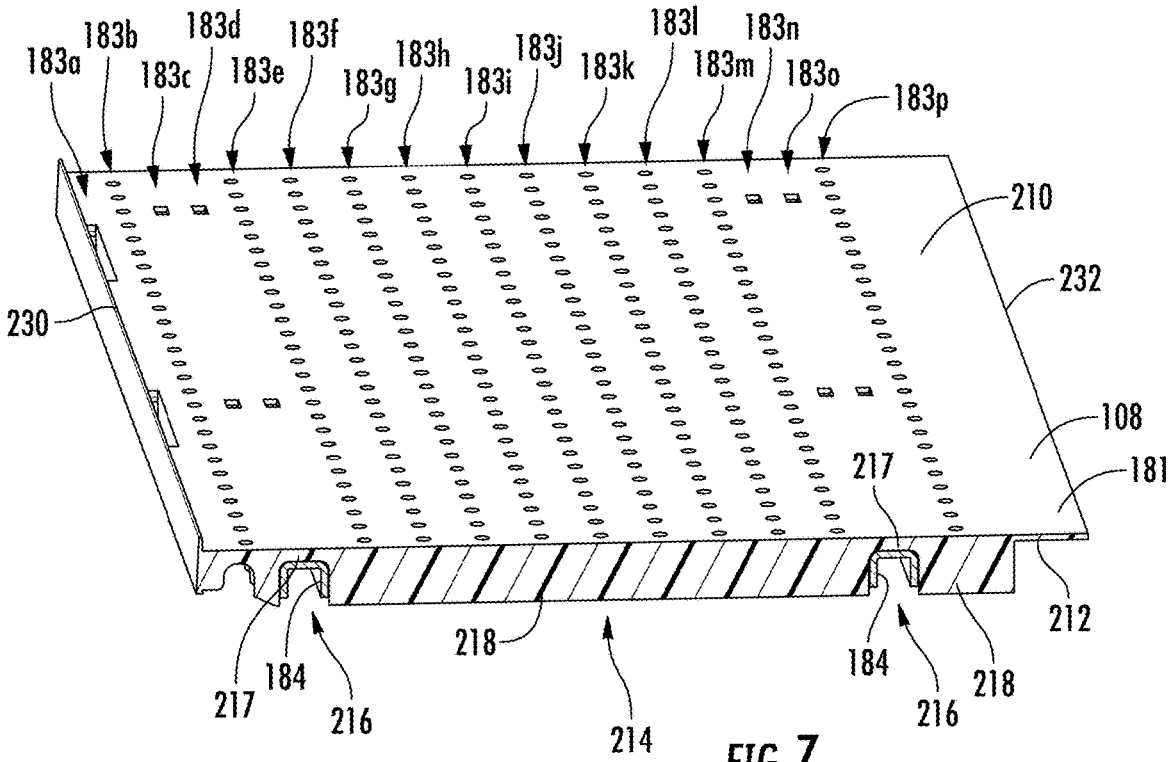
FIG. 7 is a perspective cross-sectional illustration of the shelf of FIG. 5.

In the embodiment illustrated in FIG. 7, the apertures in panel 181 form a plurality of different rows of apertures. The rows of apertures extend generally parallel to a horizontal axis that is perpendicular to an axis extending between the front and rear edges 230, 232. The plurality of apertures, numbered moving in a direction from the front edge 230 towards the rear edge 232, forms the following horizontal rows: a plurality of first apertures 183a forming a first row, a plurality of second apertures 183*b* forming a second row, a plurality of third apertures 183*c* forming a third row, a plurality of fourth apertures 183*d* forming a fourth row, a plurality of fifth apertures 183*e* forming a fifth row, a plurality of sixth apertures 183*f* forming a sixth row, a plurality of seventh apertures 183*g* forming a seventh row, a plurality of eighth apertures 183*h* forming an eighth row, a plurality of ninth apertures 183*i* forming a ninth row, a plurality of tenth apertures 183*j* forming a tenth row, a plurality of eleventh apertures 183*k* forming an eleventh row, a plurality of twelfth apertures 1831 forming a twelfth row, a plurality of thirteenth apertures 183*m* forming a thirteenth row, a plurality of fourteenth apertures 183*n* forming a fourteenth row, a plurality of fifteenth apertures 1830 forming a fifteenth row, and a plurality of sixteenth apertures 183*p* forming a sixteenth row.

As illustrated, different rows may have different numbers of apertures, different aperture spacings and the apertures thereof may have different sizes or shapes. For example, the first row formed by the first plurality of apertures 183*a* forms a horizontal row with fewer apertures that are sized and shaped differently than the plurality of second apertures 183*b* of the second row. The spacing between the first and last apertures in the rows from the adjacent sides of the panel 181 may vary from one row to the next, see for example the third row and the fifth row.

For example, the first apertures 183*a*, third apertures 183*c*, fourth apertures 183*d*, fourteenth apertures 183*n*, and fifteenth apertures 1830 are all elongated parallel to the horizontal axis (see also FIG. 3), while the second apertures 183*b*, fifth through thirteenth apertures 183*e*-183*m*, and sixteenth apertures 183*p* are not so horizontally elongated.

Also, some rows may be substantially identical. For example, the fifth through thirteenth rows are substantially identical other than their positioning between the front and rear edges 230, 232.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A shelf comprising:

a frame including:

a front support bar extending generally parallel to a horizontal axis;

a rear support bar extending generally parallel to the horizontal axis; and a first deck panel supported by the front and rear support bars, the first deck panel having an upper support surface configured to support merchandise, the first deck panel having a front end and rear end, a first axis extends between the front and rear ends, the first axis being generally perpendicular to the horizontal axis, the first deck panel being formed from plastic, the first deck panel having:

a plurality of first apertures formed in the upper support surface, the plurality of first apertures defining a first row, the first row extending generally parallel to the horizontal axis, each first aperture being elongated generally parallel to the horizontal axis;

a plurality of second apertures formed in the upper support surface, the plurality of second apertures defining a second row, the second row extending generally parallel to the horizontal axis, the second row being offset from the first row towards the rear end, each second aperture being elongated generally parallel to the first axis;

a plurality of third apertures formed in the upper surface, the plurality of third apertures defining a third row, the third row extending generally parallel to the horizontal axis, the third row being offset from the second row toward the rear end, each third aperture being elongated generally parallel to the horizontal axis;

a plurality of fourth apertures formed in the upper surface, the plurality of fourth apertures defining a fourth row, the fourth row extending generally parallel to the horizontal axis, the fourth row being offset from the third row toward the rear end, each fourth aperture being elongated generally parallel to the first axis; and a plurality of fifth apertures formed in the upper support surface, the plurality of fifth apertures defining a fifth row, the fifth row extending generally parallel to the horizontal axis, the fifth row being offset from the fourth row towards the rear end, each fifth aperture being elongated generally parallel to the horizontal axis;

wherein:

the third row includes a first third aperture and a last third aperture;

the first third aperture of the third row being positioned closer to a first edge of the deck panel than the rest of the plurality of third apertures, the first third aperture being spaced a first distance from the first edge;

the last third aperture of the third row being positioned closer to a second edge of the deck panel than the rest of the plurality of third apertures, the last third aperture being spaced a second distance from the second edge;

the first and second edges extending generally parallel to the first axis;

the fourth row includes a first fourth aperture and a last fourth aperture;

the first fourth aperture of the fourth row being positioned closer to the first edge of the deck panel than the rest of the plurality of fourth apertures, the first fourth aperture being spaced a third distance from the first edge;

the last fourth aperture of the plurality of fourth apertures being positioned closer to the second edge of the deck panel than the rest of the plurality of fourth apertures, the last fourth aperture being spaced a fourth distance from the second edge; and the first distance being greater than the third distance and the second distance being greater than the fourth distance;

a fifth distance between the first third aperture and the last third aperture is less than a sixth distance between the first fourth aperture and the last fourth aperture;

the fifth row includes a first fifth aperture and a last fifth aperture;

the first fifth aperture of the fifth row being positioned closer to the first edge of the deck panel than the rest of the plurality of fifth apertures, the first fifth aperture being spaced the first distance from the first edge;

the last fifth aperture of the fifth row being positioned closer to the second edge of the deck panel than the rest of the plurality of fifth apertures, the last fifth aperture being spaced the second distance from the second edge;

wherein:

each third aperture is substantially rectangular including first, second, third and fourth sides;

the first and second sides of each third aperture being spaced apart, generally parallel to one another and generally parallel to the horizontal axis;

the third and fourth sides of each third aperture being spaced apart, generally parallel to one another, generally parallel to the first axis, and generally perpendicular to the first and second sides of the corresponding third aperture;

each fifth aperture is substantially rectangular including first, second, third and fourth sides;

the first and second sides of each fifth aperture being spaced apart, generally parallel to one another and generally parallel to the horizontal axis;

the third and fourth sides of each fifth aperture being spaced apart, generally parallel to one another, generally parallel to the first axis, and generally perpendicular to the first and second sides of the corresponding fifth aperture.

2. The shelf of claim 1, further comprising a plurality of sixth apertures formed in the upper support surface, the plurality of sixth apertures defining a sixth row, the sixth row extending generally parallel to the horizontal axis, the sixth row being offset from the fifth row towards the rear end.

3. The shelf of claim 2, further comprising a plurality of seventh apertures formed in the upper support surface, the plurality of seventh apertures defining a seventh row, the seventh row extending generally parallel to the horizontal axis, each seventh aperture being elongated.

4. The shelf of claim 1, further comprising a front fence, the front fence having a mounting projection, the first apertures of the plurality of first apertures being sized and configured to receive the mounting projection; and wherein the plurality of first apertures is located closer to the front end than any other apertures formed in the first deck panel.

5. The shelf of claim 1, wherein the first deck panel further includes ribbing extending from a bottom surface, the bottom surface being opposite the upper surface, the bottom surface facing the front and rear support bars.

6. The shelf of claim 1, wherein the third row overlaps the front support bar and the fifth row overlaps the rear support bar.

7. A shelf comprising:

a frame including:

a front support bar extending generally parallel to a horizontal axis;

a rear support bar extending generally parallel to the horizontal axis; and a first deck panel supported by the front and rear support bars, the deck panel having an upper support surface configured to support merchandise, the first deck panel having a front end and rear end, a first axis extends between the front and rear ends, the first axis being generally perpendicular to the horizontal axis, the first deck panel being formed from plastic, the first deck panel having:

a plurality of first apertures formed in the upper support surface, the plurality of first apertures defining a first row, the first row extending generally parallel to the horizontal axis, each first aperture being elongated generally parallel to the horizontal axis;

a plurality of second apertures formed in the upper support surface, the plurality of second apertures defining a second row, the second row extending generally parallel to the horizontal axis, the second row being offset from the first row towards the rear end, each second aperture being elongated generally parallel to the first axis;

a plurality of third apertures formed in the upper surface, the plurality of third apertures defining a third row, the third row extending generally parallel to the horizontal axis, the third row being offset from the second row toward the rear end, each third aperture being elongated generally parallel to the horizontal axis;

a plurality of fourth apertures formed in the upper surface, the plurality of fourth apertures defining a fourth row, the fourth row extending generally parallel to the horizontal axis, the fourth row being offset from the third row toward the rear end, each fourth aperture being elongated generally parallel to the first axis;

a plurality of fifth apertures formed in the upper support surface, the plurality of fifth apertures defining a fifth row, the fifth row extending generally parallel to the horizontal axis, the fifth row being offset from the fourth row towards the rear end, each fifth aperture being elongated generally parallel to the horizontal axis; and wherein:

the third row includes a first third aperture and a last third aperture;

the first third aperture of the third row being positioned closer to a first edge of the deck panel than the rest of the plurality of third apertures, the first third aperture being spaced a first distance from the first edge:

the last third aperture of the third row being positioned closer to a second edge of the deck panel than the rest of the plurality of third apertures, the last third aperture being spaced a second distance from the second edge;

the first and second edges extending generally parallel to the first axis;

the fourth row includes a first fourth aperture and a last fourth aperture;

the first fourth aperture of the fourth row being positioned closer to the first edge of the deck panel than the rest of the plurality of fourth apertures, the first fourth aperture being spaced a third distance from the first edge;

the last fourth aperture of the plurality of fourth apertures being positioned closer to the second edge of the deck panel than the rest of the plurality of fourth apertures, the last fourth aperture being spaced a fourth distance from the second edge; and the first distance being greater than the third distance and the second distance being greater than the fourth distance.

8. The shelf of claim 7, further comprising a plurality of sixth apertures formed in the upper support surface, the plurality of sixth apertures defining a sixth row, the sixth row extending generally parallel to the horizontal axis, the sixth row being offset from the fifth row towards the rear end.

9. The shelf of claim 8, further comprising a plurality of seventh apertures formed in the upper support surface, the plurality of seventh apertures defining a seventh row, the seventh row extending generally parallel to the horizontal axis, each seventh aperture being elongated.

10. The shelf of claim 7, wherein a fifth distance between the first third aperture and the last third aperture is less than a sixth distance between the first fourth aperture and the last fourth aperture.

11. The shelf of claim 7, wherein:

the fifth row includes a first fifth aperture and a last fifth aperture;

the first fifth aperture of the fifth row is positioned closer to the first edge of the deck panel than the rest of the plurality of fifth apertures, the first fifth aperture being spaced the first distance from the first edge;

the last fifth aperture of the fifth row is positioned closer to the second edge of the deck panel than the rest of the plurality of fifth apertures, the last fifth aperture being spaced the second distance from the second edge.

12. The shelf of claim 7, further comprising a front fence, the front fence having a mounting projection, the mounting projection is sized and configured to be inserted into a corresponding one of the first apertures.

13. The shelf of claim 7, wherein the plurality of first apertures are located closer to the front end than any other apertures formed in the first deck panel.

14. The shelf of claim 7, wherein:

each third aperture is substantially rectangular including first, second, third and fourth sides;

the first and second sides of each third aperture being spaced apart, generally parallel to one another and generally parallel to the horizontal axis;

the third and fourth sides of each third aperture being spaced apart, generally parallel to one another, generally parallel to the first axis, and generally perpendicular to the first and second sides of the corresponding third aperture;

each fifth aperture is substantially rectangular including first, second, third and fourth sides;

the first and second sides of each fifth aperture being spaced apart, generally parallel to one another and generally parallel to the horizontal axis;

the third and fourth sides of each fifth aperture being spaced apart, generally parallel to one another, generally parallel to the first axis, and generally perpendicular to the first and second sides of the corresponding fifth aperture.

15. The shelf of claim 7, wherein the first deck panel further includes ribbing extending from a bottom surface, the bottom surface being opposite the upper surface, the bottom surface facing the front and rear support bars.

16. A shelf comprising:

a frame including:

a front support bar extending generally parallel to a horizontal axis;

a rear support bar extending generally parallel to the horizontal axis; and a first deck panel supported by the front and rear support bars, the deck panel having an upper support surface configured to support merchandise, the first deck panel having a front end and rear end, a first axis extends between the front and rear ends, the first axis being generally perpendicular to the horizontal axis, the first deck panel being formed from plastic. the first deck panel having:

a plurality of first apertures formed in the upper support surface, the plurality of first apertures defining a first row, the first row extending generally parallel to the horizontal axis, each first aperture being elongated generally parallel to the horizontal axis:

a plurality of second apertures formed in the upper support surface, the plurality of second apertures defining a second row, the second row extending generally parallel to the horizontal axis, the second row being offset from the first row towards the rear end, each second aperture being elongated generally parallel to the first axis;

a plurality of third apertures formed in the upper surface, the plurality of third apertures defining a third row, the third row extending generally parallel to the horizontal axis, the third row being offset from the second row toward the rear end. each third aperture being elongated generally parallel to the horizontal axis;

a plurality of fourth apertures formed in the upper surface, the plurality of fourth apertures defining a fourth row, the fourth row extending generally parallel to the horizontal axis, the fourth row being offset from the third row toward the rear end, each fourth aperture being elongated generally parallel to the first axis;

a plurality of fifth apertures formed in the upper support surface, the plurality of fifth apertures defining a fifth row, the fifth row extending generally parallel to the horizontal axis. the fifth row being offset from the fourth row towards the rear end, each fifth aperture being elongated generally parallel to the horizontal axis; and wherein the third row overlaps the front support bar and the fifth row overlaps the rear support bar.

* * * * *